United States Patent [19]

Fish

[11] 4,188,703

[45] Feb. 19, 1980

[54] IMPACT TOOL, HANDLE ASSEMBLY THEREFOR, AND METHOD OF ATTACHING HANDLE TO HEAD

[76] Inventor: Herbert L. Fish, 6525 Kerns Rd., Falls Church, Va. 22044

[21] Appl. No.: 876,530

[22] Filed: Feb. 9, 1978

Related U.S. Application Data

[62] Division of Ser. No. 590,565, Jun. 26, 1975, Pat. No. 4,085,784.

[51] Int. Cl.[2] ..... B25G 3/00; B25D 1/00

[52] U.S. Cl. ..... 29/460; 29/525; 76/103; 145/29 B

[58] Field of Search ..... 76/103; 145/29 R, 29 B, 145/36, 61 M, 61 R, 61 F, 61 H, 61 K, 2 R; 29/428, 460, 525

[56] References Cited

U.S. PATENT DOCUMENTS

| | | | |
|---|---|---|---|
| 255,166 | 3/1882 | Hardie | 145/29 R |
| 786,630 | 4/1905 | Cochran | 29/428 |
| 1,435,851 | 11/1922 | Isham | 145/29 B |
| 1,508,874 | 9/1924 | Christensen | 145/29 R |
| 2,067,751 | 1/1937 | Beegle | 145/29 B |
| 2,656,225 | 10/1953 | Saylor | 145/29 B |
| 3,172,708 | 3/1965 | Reuterfors | 145/29 R |
| 3,897,534 | 7/1975 | Stephens | 29/525 |
| 4,047,278 | 9/1977 | Kurata | 29/460 |

*Primary Examiner*—Robert Louis Spruill
*Assistant Examiner*—J. T. Zatarga
*Attorney, Agent, or Firm*—Shapiro and Shapiro

[57] ABSTRACT

An impact tool, such as a hammer, having a head with a tapered eye therethrough, is attached to a handle by means of longitudinal notches extending from the end of the handle inserted into the eye, the notches having longitudinal surfaces which diverge to match the taper of the eye and receiving inserts which fill the notches and the space between the longitudinal notch surfaces and the corresponding taper-forming side surfaces of the eye. Shock absorption is provided by elastomeric material filling the voids between the handle and the head of the tool.

8 Claims, 5 Drawing Figures

IMPACT TOOL, HANDLE ASSEMBLY THEREFOR, AND METHOD OF ATTACHING HANDLE TO HEAD

This is a divisional application of Ser. No. 590,565, filed June 26, 1975, now U.S. Pat. No. 4,085,784, dated Apr. 25, 1978.

BACKGROUND OF THE INVENTION

This invention is concerned with impact tools and more particularly with the attachment of the handle to the head of the tool.

In conventional hammers employing wooden handles, an end portion of the handle is inserted into the tapered eye of the head and wedges are driven into the terminal surface of the end portion so as to expand the handle into the eye. One problem with this mode of attachment is that the wood of the handle must necessarily be split to receive the wedges, weakening the handle. Another problem is that the handle tends to loosen after the tool has been used for a while. Handles are also secured to the heads of impact tools by adhesives, such as epoxy resins, but this technique requires careful preparation of the parts to insure cleanliness and a strong bond. Metal handles are attached to the heads of impact tools by special expansion techniques which are limited in application and which are expensive.

It has also been proposed to attach the handle to the head of an impact tool by means of pieces or inserts fitting between the sides of the handle and the corresponding side surfaces of the head eye. For example, U.S. Pat. No. 255,166 issued to Hardie discloses an arrangement in which the end portion of the handle is inserted through and projected far beyond the eye of the head. Then wedge pieces are fitted to the sides of the end portion, each piece having a protrusion which fits within a corresponding notch of the handle. Then the assembled wedge pieces and handle are driven back into the eye of the head. A problem with this arrangement is that much of the handle material must be removed to provide the notches which lock the wedge pieces to the handle, significantly weakening the handle, and the wedge pieces must be carefully tailored to the handle so that the necessary wedging action is obtained.

U.S. Pat. No. 241,647 to Grellner discloses an arrangement in which S-shaped pieces secure a handle to a head having an eye with a special shape to receive the attachment pieces. This arrangement clearly has no general utility.

U.S. Pat. No. 1,508,874 to Christensen discloses an arrangement in which pieces fit between the sides of the handle and the associated sides of the eye, the pieces being provided with projections to lock over the edges of the inner and outer openings of the eye, and in some cases the inner ends of the attachment pieces are secured to the handle by a bolt or rivet. This arrangement requires peculiarly shaped fastening pieces, is difficult to effect, or requires weakening of the handle to receive a rivet or bolt. In the absence of the rivet or bolt, the attachment of the handle to the head by wedging action is deficient.

Swiss Pat. No. 150,381 (1932) to Kunz, French Pat. No. 1,038,020 (1953) to Perrin and Fr. Pat. No. 737,291 (1932) to Fouquet teach other arrangements for securing the handle to the head of an impact tool, but these arrangements suffer from various deficiencies and none is of general utility. Although Fr. Pat. No. 737,291 discloses the broad use of shock absorbing elastomeric material, and such material is preferably utilized in the present invention, the environment in which that material is used (the fastening technique) is entirely different from the present invention as will be seen hereinafter.

BRIEF DESCRIPTION OF THE INVENTION

It is accordingly a principal object of the present invention to provide improved impact tools, improved handle assemblies for impact tools, and improved methods of attaching handles to the heads of impact tools, and in particular to provide improved apparatus and methods for overcoming the deficiencies and disadvantages of the prior art.

Briefly stated, in accordance with a preferred embodiment of the invention, the end portion of a handle received within the tapered eye of the head of an impact tool is provided with a longitudinal notch at opposite sides thereof, the notches having longitudinal surfaces which extend along the handle from the terminal surface of the end portion and which diverge in a direction toward the terminal surface, the angle of divergence matching the angle of divergence of the associated side surfaces of the eye of the head. Each notch receives an insert which fills the space between the associated longitudinal notch surface and the corresponding taper-forming side surface of the eye. Each notch has a terminating transverse surface also engaged by the corresponding insert, and the inserts are preferably bonded to the head after the handle and inserts have been properly positioned in the head. Elastomeric material is preferably employed to fill the voids between the handle and the head to absorb shock.

BRIEF DESCRIPTION OF THE DRAWINGS

The invention will be further described in conjunction with the accompanying drawings, which illustrate preferred and exemplary embodiments, and wherein:

Referring to the drawing and initially to FIGS. 1-4, an impact tool in accordance with the invention, a claw hammer, for example, comprises a handle 12 and a head 14. As shown in FIG. 2, the head has a tapered eye or socket 16 therethrough extending between an outer opening 18 and a smaller inner opening 20, at least the opposite side surfaces 22 and 24 of the eye diverging from the inner opening 20 to the outer opening 18. Typically the included angle of divergence between side surfaces 22 and 24 may be about 6°, so that each side surface of the eye diverges by 3° from the longitudinal axis of the eye. Handle 12, formed of wood in the example shown (although the handle may be formed of many other materials, such as fiberglass, steel, etc.) has an end portion 26 which is received within the eye 16. The terminal surface 28 of the end portion is of course small enough to fit through inner opening 20 of the eye, and the side surfaces 30 and 32 of the end portion are usually parallel. Conventionally the wooden handle has a slight bulge 34 beneath the head, limiting the insertion of the handle into the eye.

Figure 1:
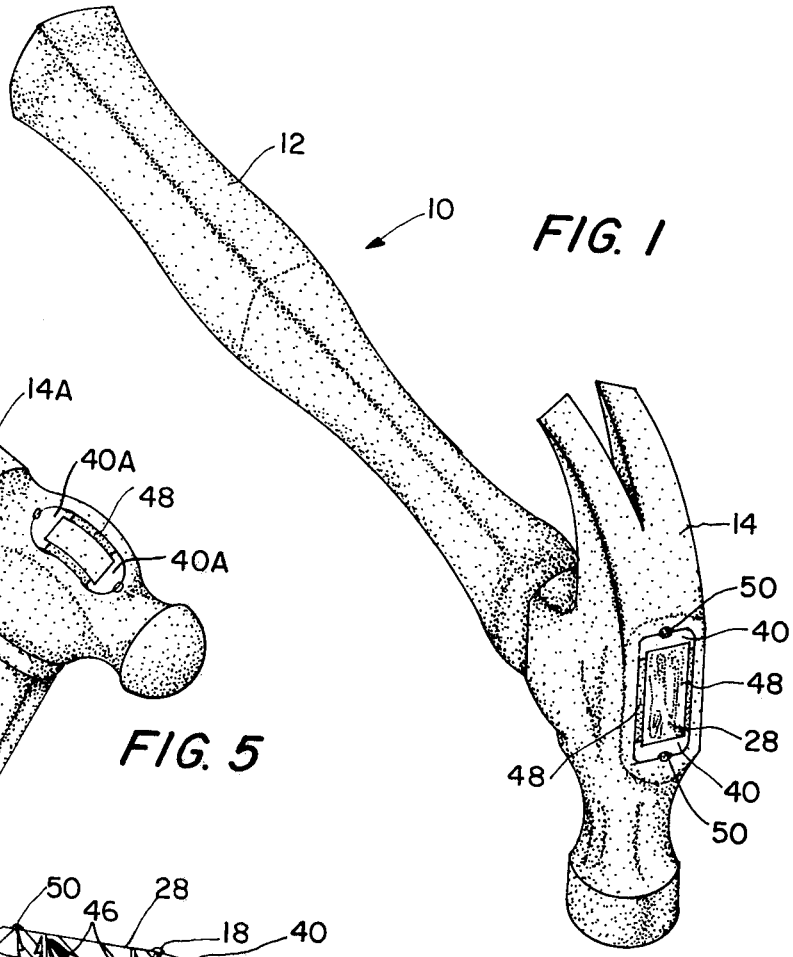
FIG. 1 is a perspective view of an impact tool in accordance with the invention.

In accordance with the invention, a longitudinal notch 35 is provided at each side of the handle associated with the taper-forming sides 22 and 24 of the eye. Each notch comprises a longitudinal surface 36 extending along the handle from the terminal surface 28 substantially continuously to a transverse surface 38. Longitudinal surfaces 36 of the notches diverge with substantially the same angle of divergence as the associated sides of the eye of the head and are thus substantially parallel thereto. The notches extend along the handle to the central region of the end portion within the eye. In the form shown the length of each notch is about one inch, slightly less than half the length of the eye, and the depth (transversely along surface 38) is about $\frac{1}{8}$ inch. The length of the notches (and inserts to be described) may correspond to the wedged length of conventional wooden handles.

Figure 4:
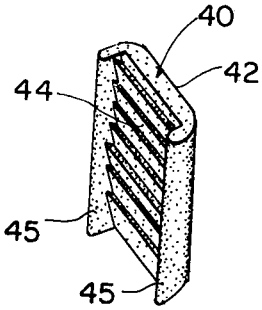
FIG. 4 is a perspective view of an insert employed in the invention.
Figure 3:
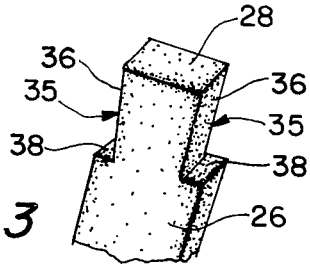
FIG. 3 is a fragmentary perspective view of an end portion of the handle.

Each notch receives an insert 40, one of which is shown in FIG. 4. Each insert has longitudinal surfaces 42 and 44, surface 42 being adapted to engage a side surface 22 or 24 of the eye and surface 44 being adapted to engage a longitudinal surface 36 of a notch. As shown, surfaces 42 and 44 (or either of them) may be serrated, with the serrations oriented slightly toward the terminal surface 28 of the handle when the inserts are inserted in the corresponding notches as shown in FIG. 3. Each insert may have ears 45 which embrace corners of the handle end portion 26 to assist in positioning the handle end portion centrally in the eye of the head. The inserts are preferably formed of a hard material, such as case hardened mild steel, although inserts of hard plastic or wood or other material may be appropriately used for some applications.

To assemble a handle with an impact tool in accordance with one method (another method will be described later) the notched end portion 26 of handle 12 is inserted through inner opening 20 of the eye of the head, and the insertion is continued until terminal surface 28 protrudes somewhat from the outer opening 18 of the eye (say by 3/16 inch for an eye having a total height of 1&$\frac{7}{8}$ inches, a width at the inner opening 20 between side surfaces 22 and 24 of 1&1/16 inches and a width at the outer opening 18 of 1&3/16 inches). Then the inserts 40 are placed in the associated notches, which may have been previously lined with stainless steel tape 46 if desired. Next the assembled handle and inserts are driven downwardly into the eye of head 14 until the terminal surface 28 and the outer ends of the inserts are flush with outer opening 18 of the eye or slightly recessed therein.

Since longitudinal surfaces 36 of the notches are substantially parallel to the associated side surfaces 22 and 24 of the eye and since the inserts, which are of substantially uniform thickness, fill the spaces between the associated longitudinal surfaces of the notches and side surfaces of the eye, the taper provided by the diverging outer longitudinal surfaces 42 of the inserts matches the taper of the eye. Since the width of the eye becomes smaller in moving toward the inner opening 20, the assembly of inserts and handle end portion is secured more tightly together within the eye if the handle is pulled relative to the head in a direction tending to withdraw the handle through inner opening 20. The handle cannot be pulled out from between the inserts, because the width of the handle end portion at surface 28 is greater than that of the handle end portion between surface 28 and surfaces 38, the distance between the inner (lower) ends of inserts 40 being smaller than the distance between the outer (upper) ends. The serrations on surfaces 44 of the inserts assist in preventing slippage between the inserts and the handle. The serrations on surfaces 42 tend to prevent loosening of the assembly by movement of the handle toward opening 18. Also, the inserts 40 may be bonded to the head, and if they are formed of metal, they may be bonded to a metal head by spot welding at 50. This bond can be readily broken when necessary to replace a handle.

Any voids between the handle end portion and the head are preferably filled with an elastomeric material, such as silicone rubber, as shown at 48 in FIG. 1. These voids may be located, for example, between the remaining side surfaces of the handle end portion and the corresponding side surfaces of the eye. By this technique substantial absorption of shock is achieved when the tool is used.

Figure 2:
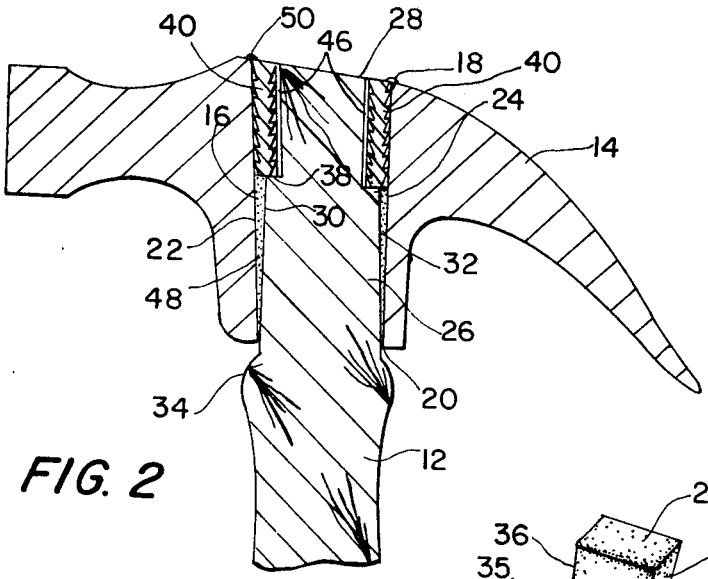
FIG. 2 is a fragmentary longitudinal sectional view of the impact tool of FIG. 1.

In accordance with another method of assembling a handle and impact tool head by virtue of the invention, a wooden handle, for example, having a knob or bulge 34 as in FIG. 2 may be inserted in the eye until the head 14 rests on the knob (the length of the handle beyond the knob approximately matching the length of the eye). One insert 40 may simply be dropped into its notch 35. Then the other insert may be driven into its notch (or both inserts may be driven in). The inserts driven in may be slightly over-size in thickness, so as to compress the handle material somewhat, if wood, and may be slightly tapered or rounded at the leading end to facilitate initial insertion. A wooden handle may be dried out at the end portion by the application of heat just prior to insertion of the handle in the head. Then the natural expansion of the wood upon absorption of moisture will further tighten the handle attachment. If desired, a conventional sealer may then be applied to the handle surfaces at opposite ends of the eye to retain the moisture. Also, glue may be applied to longitudinal surfaces of the inserts. If the head rests securely on knob 34 before the final insert is driven in, then bonding of the inserts to the head to resist further movement of the handle toward the outer opening of the eye (and loosening of the attachment) can be eliminated.

Figure 5:
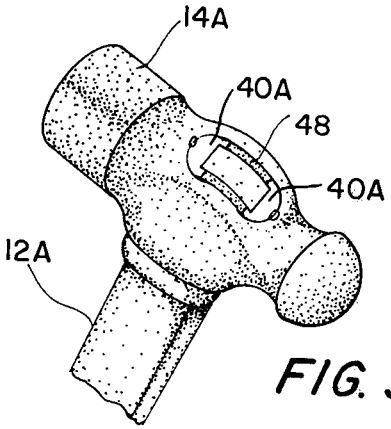
FIG. 5 is a fragmentary perspective view of a modification.

The invention may be applied to other types of impact tools, including other types of hammers, such as the ball peen hammer illustrated in FIG. 5. In some ball peen hammers the eye is approximately hourglass shaped, i.e., half of the eye diverges toward the inner opening and half diverges toward the outer opening. Here of course the portion of the eye diverging toward the outer opening serves the same function as the eye of the claw hammer of FIG. 3, and the notches of the handle will have a divergence matching the divergence of the eye adjacent to the outer opening. The inserts 40A used with the handle 12A and the ball peen head 14A in FIG. 5 may have greater curvature than the inserts 40 so as to better match the shape of the eye of the ball peen head. Nevertheless, the inserts will have substantially uniform thickness so that the longitudinal surfaces mate with the longitudinal surfaces of the notches and the associated side surfaces of the eye. Again, elastomeric material 48 may be employed to fill the voids. The handle in FIG. 5 is, for purposes of illustration, a fiberglass handle.

Although the use of two notches and two inserts is preferred, within the broader aspects of the invention a single notch 35 and insert 40 may be employed, with the longitudinal notch surface 36 parallel to the adjacent longitudinal surface of the eye and diverging with respect to the opposite straight (un-notched) side of the handle end portion in the direction of terminal surface 28. The wedge-shaped space between the opposite side of the handle end portion and the adjacent surface of the eye may be filled with a mating hard wedge, preferably slightly over-size, which may be driven into the space. Of course, if the last-mentioned eye surface were parallel to the axis of the eye, rather than inclined thereto, it could merely abut the un-notched straight side of the handle end portion. In either case the un-notched side of the handle is braced by the adjacent side surface of the eye (via an intervening wedge or directly) analagous bracing being effected by an insert 40 when opposite sides of the handle are notched.

It is apparent that the invention provides, in a simple and economical manner, impact tools in which the handle is attached to the head without the necessity for splitting the handle with conventional wedges and in which the same basic type of handle assembly may be employed with a wide variety of heads without requiring special eye configurations. The mode of handle-head attachment in accordance with the invention is unusually strong, the amount of handle material removed for the provision of the notches being minimal. Yet, when the handle, inserts, and head are assembled, the inserts and handle end portion in combination form an essentially unitary wedge which strongly resists withdrawal from the head through the inner eye opening.

While preferred embodiments of the invention have been shown and described, it will be apparent to those skilled in the art that changes can be made without departing from the principles and spirit of the invention, the scope of which is defined by the following claims. For example, if a handle is employed which has an end portion much smaller than the dimensions of the eye, an adapter may be secured to the end portion, and the notches may then be placed in the adapter, the adapter then serving as part of the handle.

The invention claimed is:

1. A method of attaching a handle to a head of an impact tool, said head having a tapered eye therethrough extending from an outer opening to a smaller inner opening, with a pair of opposite surfaces of said eye diverging from said inner opening to said outer opening, said method comprising forming a longitudinal notch at at least one side of an end portion of said handle, with said notch having a longitudinal surface extending along said handle from a terminal surface of said end portion and with said longitudinal surface diverging from the longitudinal surface of the opposite side of the handle end portion in a direction toward said terminal surface, inserting said end portion of said handle into said eye through said inner opening until said terminal surface is adjacent to the outer opening, thereafter providing in the space between the longitudinal surface of said notch and an adjacent taper-forming surface of said eye a hard insert that has a longitudinal surface engaging the longitudinal surface of said notch and a further longitudinal surface engaging said taper-forming surface of said eye, and bracing said longitudinal surface of said opposite side of the handle end portion by an adjacent taper-forming surface of said eye, said notch being formed with a transverse end surface located intermediate said inner and outer openings when said handle has been attached to said head and said longitudinal surface of said notch extending continuously from said transverse end surface to said terminal surface of said end portion of said handle, whereby withdrawal of said handle from said head through said inner opening is prevented.

2. A method in accordance with claim 1, said insert engages said transverse surface, and further comprising bonding said insert to said head, whereby movement of said handle toward said outer opening is prevented.

3. A method in accordance with claim 1, wherein said end portion of said handle is inserted into said eye sufficiently to protrude through said outer opening and wherein said end portion and said insert are then driven into said outer opening.

4. A method in accordance with claim 1, wherein said handle has a bulge spaced from said terminal surface and engaging said head upon insertion of said handle end portion into said eye.

5. A method in accordance with claim 1, further comprising filling voids between said handle and said head with elastomeric material to absorb shock.

6. A method in accordance with claim 1, wherein two of said notches and inserts are provided at opposite sides of said handle end portion.

7. A method of attaching a handle to a head of an impact tool in accordance with claim 1, wherein said insert is provided by inserting through said outer opening and into said space a material selected from the group consisting of wood, metal, and plastic.

8. A method of attaching a handle to a head of an impact tool in accordance with claim 1, wherein the longitudinal surface of the notch and the adjacent taper-forming surface of the eye are parallel.

* * * * *